US006467766B2

(12) United States Patent
Minamishin et al.

(10) Patent No.: US 6,467,766 B2
(45) Date of Patent: Oct. 22, 2002

(54) PAPER SHEET FEED MECHANISM

(75) Inventors: Hayato Minamishin; Yuji Tanaka; Hayami Abe, all of Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/823,758

(22) Filed: Apr. 3, 2001

(65) Prior Publication Data

US 2001/0017440 A1 Aug. 30, 2001

Related U.S. Application Data

(63) Continuation of application No. PCT/JP99/01725, filed on Apr. 1, 1999.

(30) Foreign Application Priority Data

Nov. 20, 1998 (JP) ..... 10-330720

(51) Int. Cl.[7] ..... B65H 3/06; B65H 3/52

(52) U.S. Cl. ..... 271/21; 271/22; 271/38; 271/122; 271/119

(58) Field of Search ..... 271/21, 22, 37, 271/38, 119, 121, 122

(56) References Cited

U.S. PATENT DOCUMENTS 3,645,527 A * 2/1972 Gates ..... 271/21
3,908,982 A * 9/1975 Abe ..... 271/21
4,058,305 A * 11/1977 Harada ..... 271/21
4,463,943 A * 8/1984 Deconick ..... 271/21
5,195,736 A * 3/1993 Ishidate ..... 271/22

FOREIGN PATENT DOCUMENTS

| | | |
|---|---|---|
| JP | 57-57140 | 4/1982 |
| JP | 62-47539 | 3/1987 |
| JP | 63-37643 | 3/1988 |
| JP | 64-2943 | 1/1989 |
| JP | 5-330672 | 12/1993 |
| JP | 6-42849 | 6/1994 |

* cited by examiner

*Primary Examiner*—Christopher P. Ellis
*Assistant Examiner*—Mark A. Deuble
(74) *Attorney, Agent, or Firm*—Staas & Halsey LLP

(57) ABSTRACT

An object of the paper sheet feed mechanism of the present invention is to provide a paper sheet feed mechanism in which delivery of paper sheets is stable. The paper sheet feed mechanism comprises a feed roller conveying paper money to the right direction of the drawing, a spring pressing the feed roller against the paper money, a sensor detecting the press force that the paper money receives by being pressed by the feed roller, a push-up board pushing up the paper money, and a control section regulating the height of the push-up board based on the detection result by the sensor, and also comprises a pick roller conveying the paper sheet at a conveyance speed faster than a conveyance speed by the feed roller.

1 Claim, 10 Drawing Sheets

PAPER SHEET FEED MECHANISM

This application is a continuing application, filed under 35 U.S.C. §111(a), of International Application PCT/JP99/01725, filed Apr. 1, 1999.

FIELD OF THE INVENTION

The present invention relates to a paper sheet feed mechanism which is incorporated in an OA apparatus, a finance automatic machine or the like and in which paper sheets piled up in a storage inside which paper sheets are piled up are delivered one by one from the storage, and particularly to a paper sheet feed mechanism in which the piled up paper sheets are delivered from the top thereof sequentially.

BACKGROUND ART

Various types of paper sheet feed mechanisms are conventionally known as the paper sheet feed mechanism as described above.

FIG. 9 is a view showing a first example of a conventional paper sheet feed mechanism.

Here, shown are a storage 200 inside which paper sheets 300 are piled up and a push-up board 402 suspended by springs 401 inside the storage 200. The paper sheets 300 are piled up on this push-up board 402, and the push-up board 402 is drawn upward by the force of the springs 401 so that the paper sheets 300 are pushed up by the push-up board 402. A feed roller 403 and a pick roller 404 are provided in an upper part of the storage 200, and the pushed up paper sheets 300 are pressed against the feed roller 403 and the pick roller 404. The feed roller 403 and the pick roller 404 rotate counterclockwise as shown by arrows $F_1$ and $F_2$ of the drawing so that the paper sheets 300 pressed against the feed roller 403 and the pick roller 404 are conveyed to the right direction of the drawing. In this drawing, a separator 405 provided so as to oppose to the feed roller is shown, and the paper sheets 300 conveyed to the right direction of the drawing pass between the separator 405 and the feed roller 403 while being rubbed against the separator 405. As a result of this, so-called overlap conveyance in which two or more paper sheets 300 are conveyed at one time is prevented by frictional force between the separator 405 and the paper sheets 300. The paper sheet 300 passed between the feed roller 403 and the separator 405 is conveyed to the outside of the storage 200 by conveyance rollers 406 as shown by an arrow $F_3$ of the drawing, whereby delivery of the paper sheet 300 is completed.

In this first example, since the paper sheets 300 are pushed up by the force of the springs 401 to be pressed against the feed roller 403 and the pick roller 404, when the amount of the paper sheets 300 piled up is changed, the force by which the paper sheets 300 are pressed against the feed roller 403 and the pick roller 404 changes.

FIG. 10 is a view showing a second example of a conventional paper sheet feed mechanism.

A storage 200 is shown in this FIG. 10, and in the storage 200, a push-up board 503 driven by a motor 502 via a belt 501 is shown. In the upper part of the storage 200, a feed roller 504 similar to that of the first example is provided, and further provided are a pick roller holding lever 505 which is rotatable about the rotation axis of the feed roller 504, a pick roller 506 held by the pick roller holding lever 505, and a spring 507 urging downward the pick roller 506 along with the pick roller holding lever 505.

When the push-up board 503 is driven upward, the paper sheets 300 piled up on this push-up board 503 are pushed up by the push-up board 503 to be pressed against the feed roller 504 and the pick roller 506. The pick roller 506 against which the paper sheets 300 are pressed moves upward in accordance with that press force, and the pick roller holding lever 505 accordingly rotates. A sensor 508 detecting the magnitude of the force by which the paper sheets are pressed by detecting the position of the pick roller holding lever 505 is provided in the upper part of the pick roller holding lever 505. Based on a detection result by this sensor 508, the motor 502 is controlled by a control section which is not shown so that the belt 501 is driven as shown by arrows $F_4$ and $F_5$ of the drawing, whereby the pick roller 506 is pushed up so that its position is regulated as shown by an arrow $F_6$ of the drawing. Thus, the force by which the paper sheets 300 are pressed against the pick roller 506 is stabilized.

Similar to the first example, the paper sheets 300 pressed against the feed roller 504 and the pick roller 506 are conveyed to the right side of the drawing, pass between the feed roller 504 and a separator 509, and are fed to the outside of the storage 200 by conveyance rollers 510 to complete delivery of the paper sheets.

In a paper sheet feed mechanism incorporated specifically in a finance automatic machine, it is required that delivery of paper sheets is stable even when the amount of paper sheets piled up inside the storage is variously changed or when paper sheets whose use condition is various are accommodated in the storage.

However, as described above, in the first example, when the amount of the paper sheets piled up are changed, the force by which the paper sheets are pressed against the feed roller and the pick roller changes. Therefore, when the amount of the paper sheets largely changes, delivery stability deteriorates.

In the first example and the second example described above, the overlap conveyance in which two or more paper sheets are conveyed at one time is prevented in such a manner that the paper sheet is rubbed against the separator. Since paper sheets overlapping each other are not easy to be separated, regarding new paper sheets which have just been cut, and worn-out paper sheets overlapping each other are easy to be separated, it is necessary to employ a material whose coefficient of friction is high as a material for the separator in order to surely prevent the overlap conveyance of even the paper sheets which have just been cut. However, since such material is generally soft, abrasion of a separator in which such material is employed is intense, causing a short life time. When the frictional force is large, there is a possibility that a worn-out weak paper sheet is damaged.

Further, in the first example and the second example described above, there is a possibility that it is failed to plunge the paper sheets conveyed by the pick roller between the feed roller and the separator, and as a result the paper sheets stagnate before the separator.

DISCLOSURE OF THE INVENTION

Concerning the above described circumstances, it is an object of the present invention to provide a paper sheet feed mechanism in which delivery of paper sheets is stable.

A first paper sheet feed mechanism of the present invention to achieve the object is, in a paper sheet feed mechanism feeding paper sheets inside a storage inside which the paper sheets are piled up one by one from the storage, comprising:

a feed roller conveying an uppermost paper sheet piled among the paper sheets piled up inside the storage to a predetermined conveyance direction by being in contact with the uppermost paper sheet and rotating, a pick roller being positioned behind the feed roller in the conveyance direction and conveying the uppermost paper sheet with which the feed roller is in contact to the conveyance direction at a conveyance speed faster than a conveyance speed by the feed roller by being in contact with the uppermost paper sheet and rotating, and a conveyance mechanism conveying the paper sheet fed by the feed roller and the pick roller to the outside of the storage.

Here, the conveyance mechanism and the feed roller may be one that has both roles.

With the first paper sheet feed mechanism of the present invention, since the pick roller conveys the paper sheet at the conveyance speed faster than the conveyance speed of the feed roller, the paper sheet is bent and rises between the pick roller and the feed roller, and the uppermost paper sheet and the paper sheet next thereto are separated. Thus, overlap conveyance is prevented. Further, since the uppermost paper sheet is quickly conveyed toward the feed roller by the pick roller, even when the paper sheets are piled up, being in disorder a little in the horizontal direction, the uppermost paper sheet comes in contact with the feed roller surely to be conveyed by the feed roller.

In the first paper sheet feed mechanism of the present invention, it is preferred that the feed roller is provided with one or more of a predetermined number of each of high friction portion(s) having a relatively high coefficient of friction and low friction portion(s) having a relatively low coefficient of friction in the circumferential face of the feed roller alternately in the circumferential direction thereof, the pick roller is provided with one or more of a predetermined number of each of high friction portion(s) having a relatively high coefficient of friction and low friction portion(s) having a relatively low coefficient of friction in the circumferential face of the pick roller alternately in the circumferential direction thereof, and the paper sheet feed mechanism comprises a drive mechanism driving the feed roller and the pick roller so that timing that the high friction portion of the feed roller comes in contact with the paper sheet and timing that the high friction portion of the pick roller comes in contact with the paper sheet are synchronized.

With this structure, the paper sheet can be conveyed by the conveyance mechanism when the low friction portions of both the feed roller and the pick roller are in contact with the paper sheet.

A second paper sheet feed mechanism of the present invention to achieve the object is, in a paper sheet feed mechanism feeding paper sheets inside a storage inside which the paper sheets are piled up one by one from the storage, comprising:

a feed roller conveying an uppermost paper sheet among the paper sheets piled up inside the storage to a predetermined conveyance direction, a press mechanism pressing the feed roller against a front end portion of the uppermost paper sheet among the paper sheets piled up inside the storage in the conveyance direction, a press force regulation mechanism regulating a press force that the paper sheets receive since the feed roller is pressed against the paper sheets by the press mechanism, and a conveyance mechanism conveying the paper sheet fed by the feed roller to the outside of the storage.

With the second paper sheet feed mechanism of the present invention, since the press force is regulated by the press force regulation mechanism, feed of the paper sheets by the feed roller becomes stable, and delivery of the paper sheets also becomes stable.

In the second paper sheet feed mechanism of the present invention, it is preferred that the press force regulation mechanism comprises:

a press force measuring device measuring the press force, a push-up board pushing up the paper sheets piled up inside the storage, and a regulation device regulating a height to which the push-up board pushes up the paper sheets in accordance with a measurement result by the press force measuring device.

With this structure, since the height to which the push-up board pushes up the paper sheets is regulated, a drastic change in the accommodation amount of the paper sheets can be dealt with.

In the second paper sheet feed mechanism of the present invention, it is preferred that the feed roller is movable in a direction in which the feed roller comes in/out of contact with the uppermost paper sheet, and the paper sheet feed mechanism comprises a separator separating the uppermost paper sheet and the paper sheet next to the uppermost paper sheet by being in contact with a lower face against an upper face of the paper sheet being conveyed which is in contact with the feed roller and imparting a frictional force when the paper sheet is conveyed by the feed roller, said separator moving, following the movement of the feed roller.

With this structure, since the separator moves, following the movement of the feed roller, separation of the paper sheets by the separator becomes stable, and the overlap conveyance can be prevented.

Further, it is preferred that the second paper sheet feed mechanism of the present invention comprises a pick roller being positioned behind the feed roller in the conveyance direction and conveying the uppermost paper sheet with which the feed roller is in contact to the conveyance direction by being in contact with the uppermost paper sheet and rotating and an urge mechanism urging the pick roller to the uppermost paper sheet.

With this structure, since the pick roller is urged toward the uppermost paper sheet, even when the uppermost paper sheet is uneven, the pick roller comes in contact with the uppermost paper sheet surely to convey the paper sheet. Thus, delivery of the paper sheet becomes further stable.

As explained above, with the first paper sheet feed mechanism of the present invention, since overlapped paper sheets are surely separated, delivery of the paper sheets is stable.

With the second paper sheet feed mechanism of the present invention, since the press force is stable and thus the paper sheets are conveyed stably by the feed roller, delivery of the paper sheets is stable.

BEST MODE FOR CARRYING OUT THE INVENTION

An embodiment of the present invention will be explained below. Regarding drawings, for the convenience on the explanation, drawings in which parts unnecessary for the explanation are appropriately omitted are employed.

Figure 1:
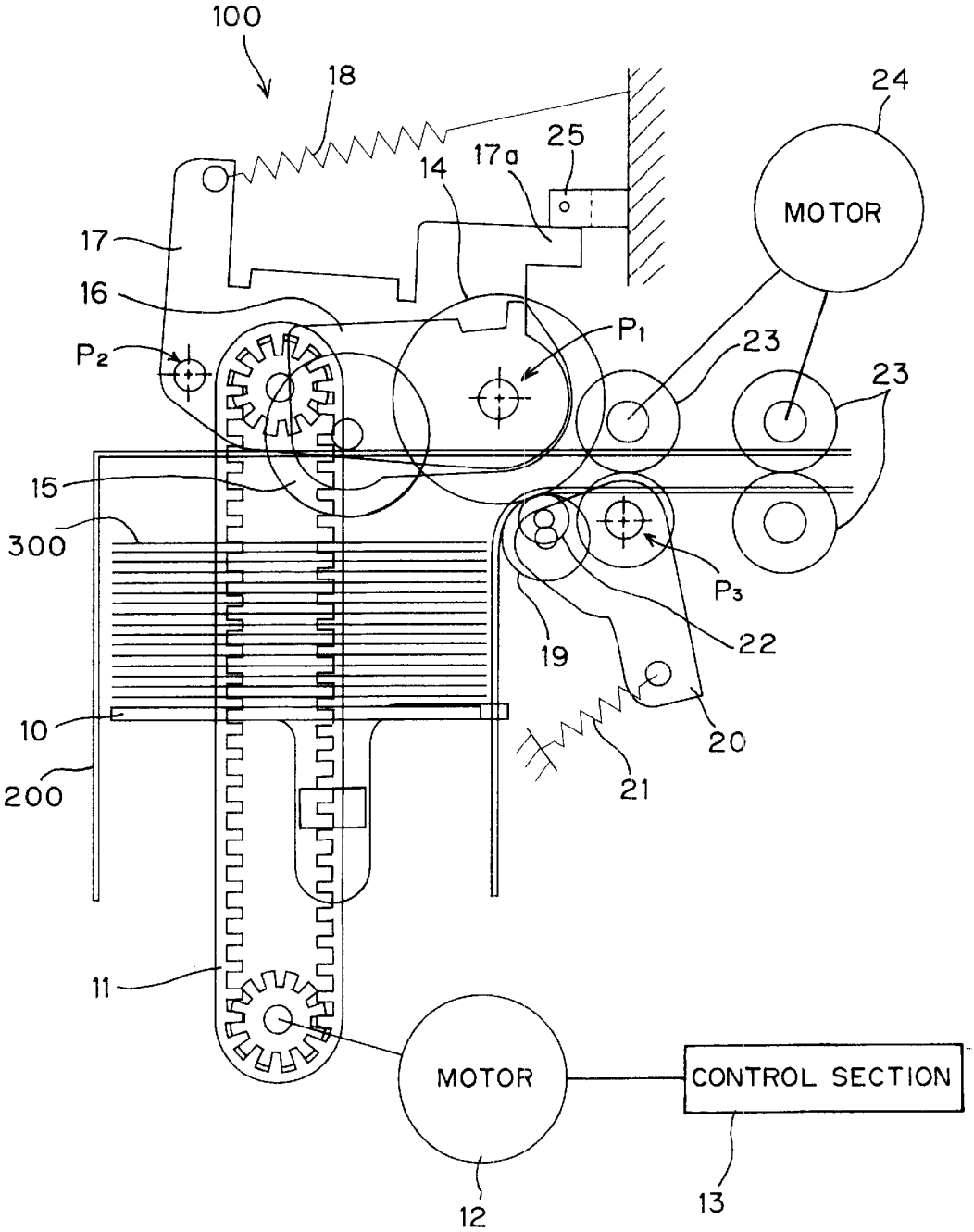
FIG. 1 is a view showing one embodiment of a paper sheet feed mechanism of the present invention.

FIG. 1 is a view showing one embodiment of the paper sheet feed mechanism of the present invention.

In this FIG. 1, a paper sheet feed mechanism 100 feeding paper money 300 from a storage 200 is shown, and a push-up board 10, a push-up board lifting/lowering belt 11, a push-up board drive motor 12, and a control section 13 are shown. The push-up board 10 is lifted/lowered inside the storage 200, and the push-up board 10 is at a lower position when the paper money 300 is accommodated so that the paper money 300 is piled up on this push-up board 10. The push-up board 10 is attached to the push-up board lifting/lowering belt 11, the push-up board lifting/lowering belt 11 is driven by the push-up board drive motor 12 so that the push-up board 11 is lifted/lowered, and the push-up board 10 is lifted so that the paper money 300 is pushed up. The operation of the push-up board drive motor 12 is controlled by the control section 13.

A feed roller 14 and a pick roller 15 are shown in the upper part of FIG. 1, and the feed roller 14 and the pick roller 15 rotate in the counterclockwise direction of the drawing to convey the paper money 300 to the right of the drawing as described later on. The pick roller 15 is held by a pick roller holding lever 16 which is rotatable about the central point $P_1$ of the rotary shaft of the feed roller 14, and the feed roller 14 is held by a feed roller holding lever 17 which is rotatable about a supporting point $P_2$ shown in the drawing. A spring 18 is shown in the upper part of the feed roller holding lever 17, and this spring 18 imparts torque of a clockwise direction of the drawing to the feed roller holding lever 17 so as to urge the feed roller 14 downward. A spring for urging the pick roller 15 downward, similar to that for the feed roller 14, is provided though its drawing is omitted in this FIG. 1.

A separator 19 is shown under the feed roller 14, and the separator 19 is held by a separator holding lever 20 which is rotatable about a supporting point $P_3$ shown in the drawing. The separator holding lever 20 receives torque of the clockwise direction of the drawing by a spring 21, whereby the separator 19 is urged upward. The feed roller 14 and the separator 19 are arranged in such a manner as to be positioned at mutually deviating positions in the perpendicular direction in the drawing so as to be out of contact with each other, and a supplementary roller 22 being in contact with the feed roller 14 is attached to the separator holding lever 20. Since this supplementary roller 22 is constantly pressed against and is in contact with the feed roller 14 by the force of the spring 21, the relative distance between the separator 19 and the feed roller 14 is maintained as described later on.

The paper money conveyed to the right of FIG. 1 by the feed roller 14 passes between the separator 19 and the feed roller 14, and during the passing time frictional resistance is imparted to the paper money by the separator 19. Thus, the uppermost paper money and the paper money second from the top among the paper money piled up inside the storage 200 are separated, thereby preventing overlap conveyance. However, as described later on, the present embodiment is provided with another mechanism for surely separating paper money which is not easy to be separated, and the separation of paper money by the separator 19 is merely the supplementary. Thus, a small frictional resistance imparted to the paper money by the separator 19 may be enough.

In the right of FIG. 1, shown are conveyance rollers 23 conveying the paper money fed to the outside of the storage 200 by the feed roller 14 and a conveyance roller drive motor 24 driving the conveyance rollers 23.

When the push-up board 10 is driven upward by the push-up board drive motor 12, the paper money 300 piled up on the push-up board 10 is pushed up by the push-up board 10 and is pressed against the pick roller 15 and the feed roller 14, whereby the pick roller 15 and the feed roller 14 are pushed up by the paper money 300. As a result, the feed roller holding lever 17 rotates in the counterclockwise direction of the drawing so that the spring 18 is stretched, and the feed roller 14 is pressed against the paper money 300 by the force responding to the stretch of the spring 18. Thus, one example of a press mechanism referred to in the present invention is composed of the spring 18 and the feed roller holding lever 17. The position of the feed roller holding lever 17 corresponds to the press force that the paper money 300 receives. An on/off sensor 25 is provided at a predetermined position in the upper part of the feed roller holding lever 17, and this on/off sensor 25 becomes an off state when a detection board 17*a* provided in the feed roller holding lever 17 reaches the predetermined position, that is, when the press force exceeds a predetermined pressure. In other words, the press force is two value measured by the on/off sensor 25. The push-up board drive motor 12 is controlled by the control section 13 based on the on/off state of the on/off sensor 25. Thus, the on/off sensor 25 is one example of a press force measuring device referred to in the present invention, and the control section 13 is one example of a regulation device referred to in the present invention.

Figure 2:
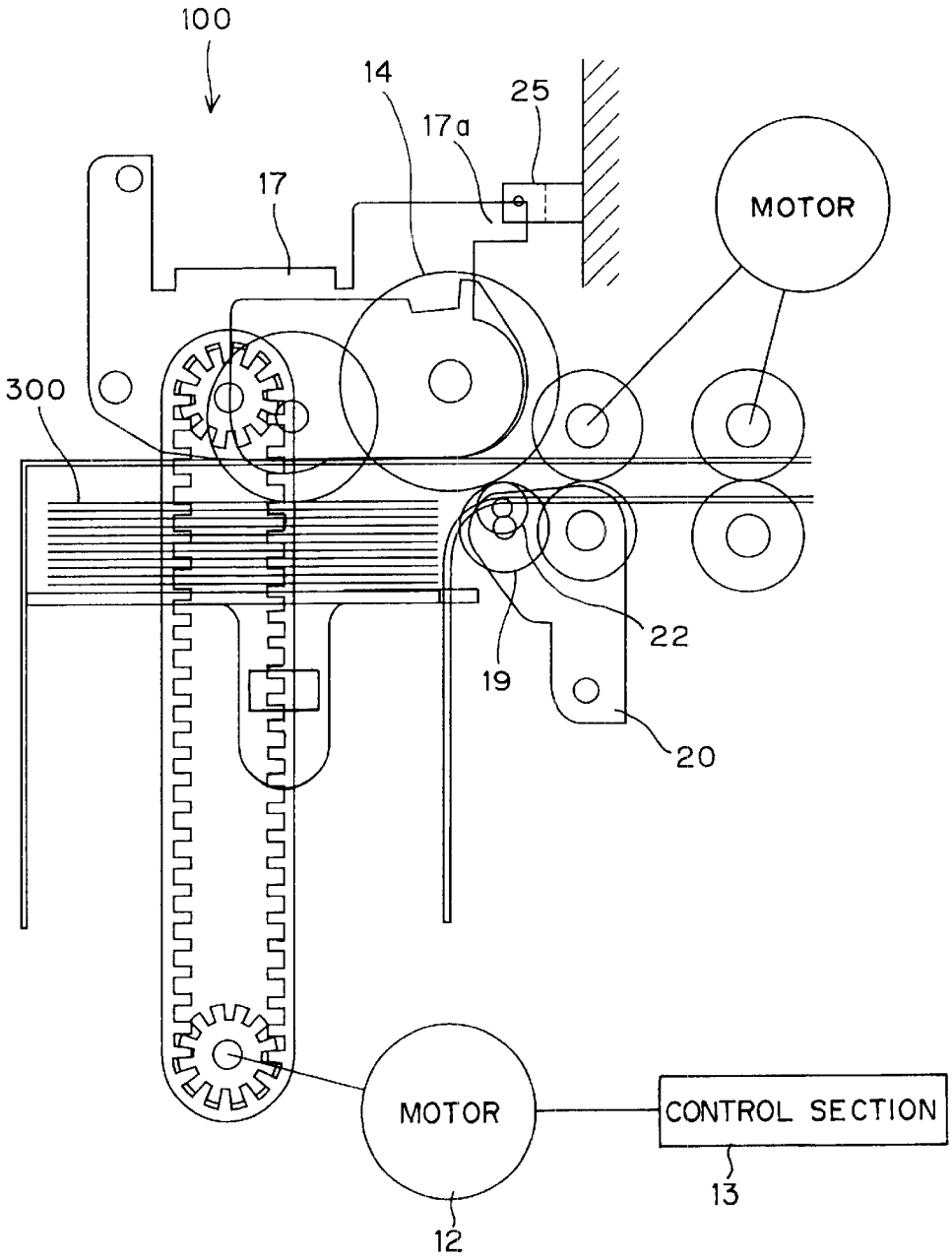
FIG. 2 is a view showing the state where paper money pushes up the feed roller.
Figure 3:
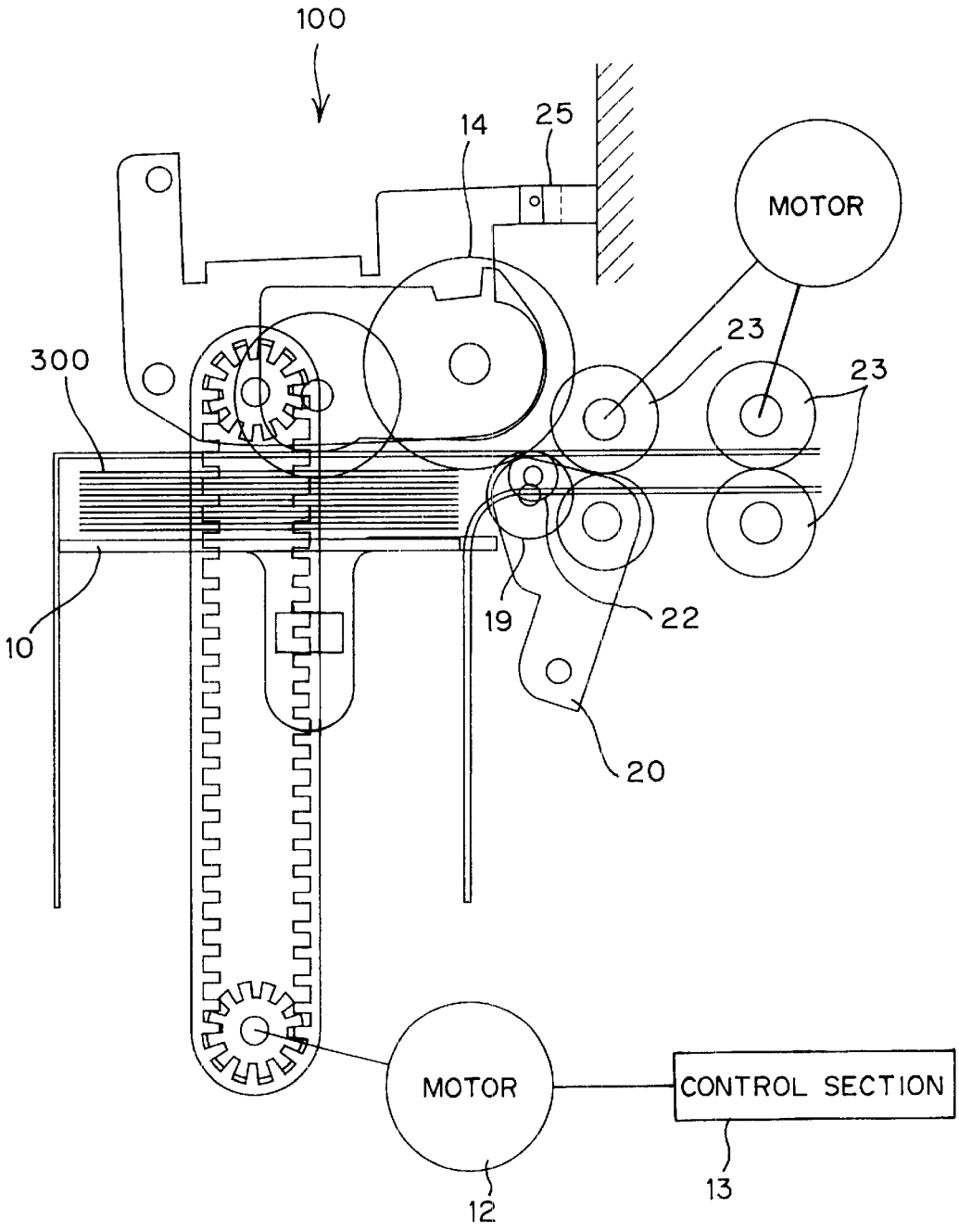
FIG. 3 is a view showing the state where the paper money pushes up the feed roller more than the state of FIG. 2.

FIG. 2 and FIG. 3 are views showing the states where the paper money pushes up the feed roller.

FIG. 2 shows the state where the detection board 17*a* provided in the feed roller holding lever 17 reaches the predetermined position described above, and when a press force greater than or equal to the press force generated in this state is generated, it is ensured that the feed roller 14 stably conveys the paper money 300.

FIG. 3 shows the state where the feed roller is pushed up more than the state shown in FIG. 2. Even in this state, it is ensured that the feed roller 14 stably conveys the paper money 300.

When the on/off sensor 25 becomes the off state, the control section 13 controls the push-up board drive motor 12 to lift the push-up board 10 only a predetermined distance, whereby the feed roller 14 is pushed up to approximately the same position as that shown in FIG. 3. After this, when the number of the paper money 300 decreases due to the delivery of the paper money 300, the press force becomes small, and the position of the feed roller 14 lowers. When the on/off sensor 25 becomes the on state, the push-up board drive motor 12 is again controlled by the control section 13 so that the push-up board 10 is lifted only a predetermined distance. This operation is repeated so that the press force that the paper money 300 receives is stable regardless of the amount of the paper money 300 accommodated. As a result, the paper money 300 is stably fed to the conveyance roller 23 by the feed roller 14.

In FIGS. 1, 2 and 3, the states where the separator follows the up/down movement of the feed roller are also shown.

The separator holding lever 20 is urged by the spring so that the supplementary roller 22 attached to the separator holding lever 20 is constantly pressed against the circumferential face of the feed roller 14. Thus, when the feed roller 14 moves, for example, from the position shown in FIG. 1 to the respective positions shown in the respective FIG. 2 and FIG. 3, the separator holding lever 20 rotates, following the movement of the feed roller 14, so that the separator 19 moves. Thus, the distance between the feed roller 14 and the separator 19 is maintained to a fixed distance to prevent the overlap conveyance of the paper money 300.

Figure 4:
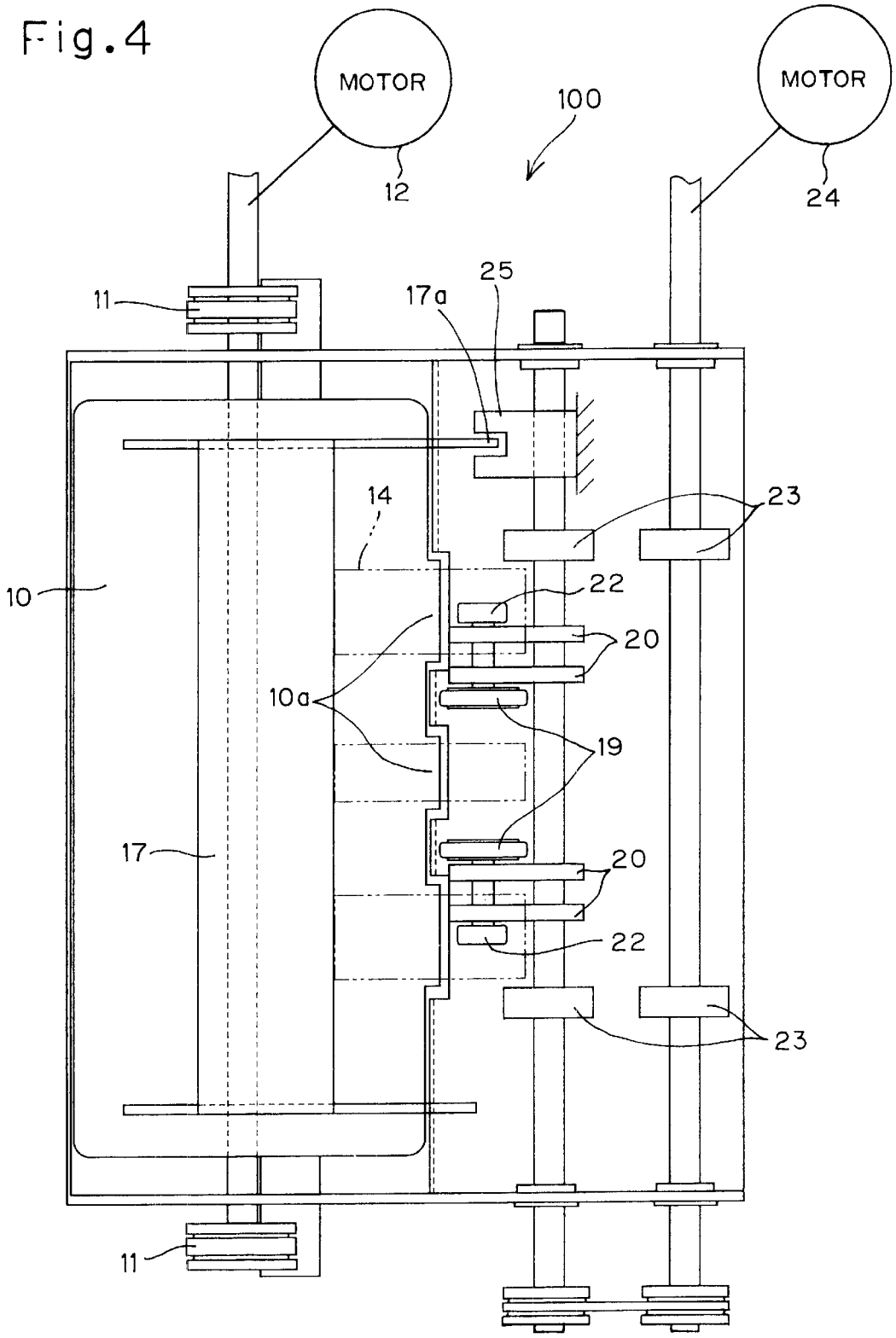
FIG. 4 is a top view in which among components of the paper sheet feed mechanism shown in FIG. 1, components arranged in a lower side of the paper money to be delivered are mainly shown.
Figure 5:
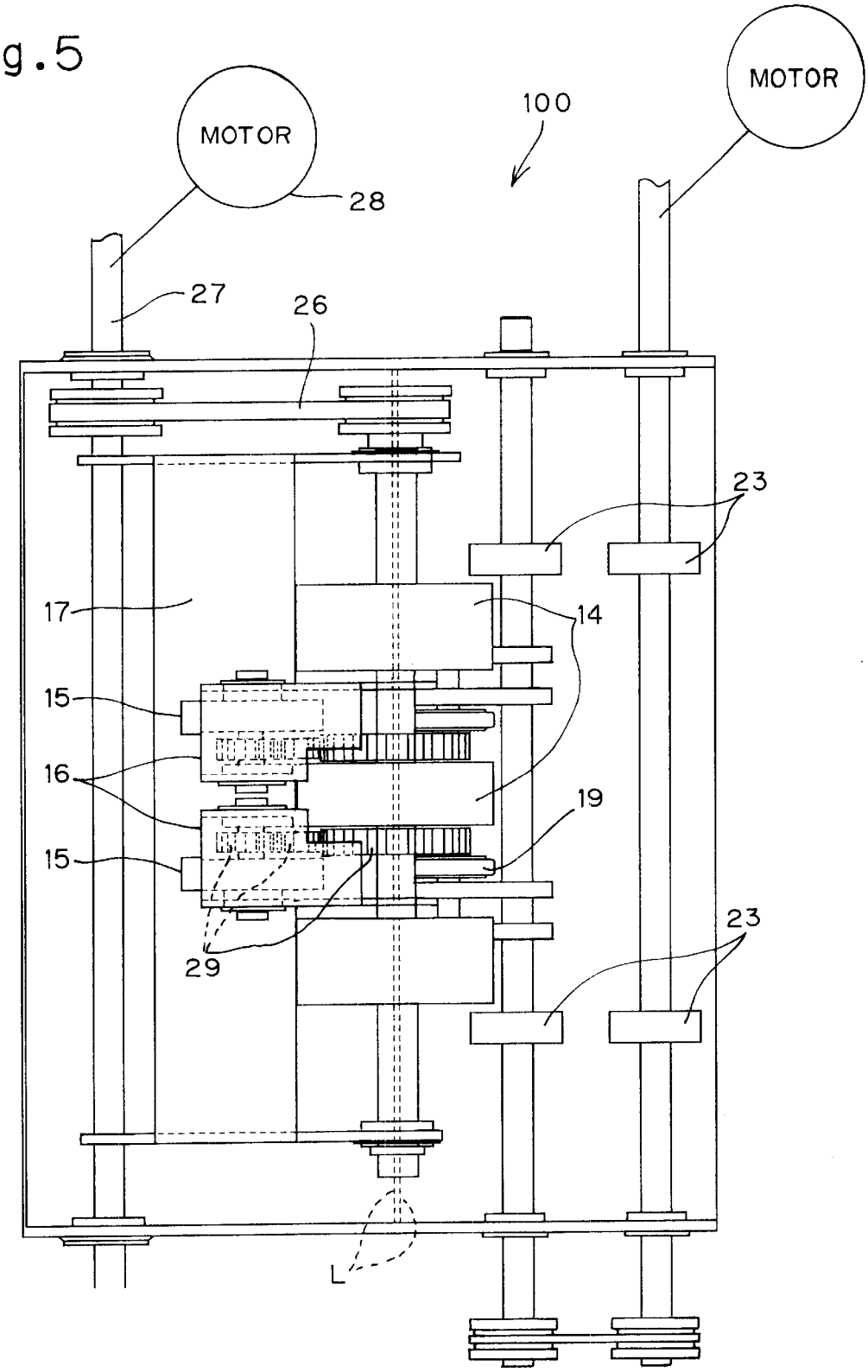
FIG. 5 is a top view in which among the components of the paper sheet feed mechanism shown in FIG. 1, components arranged in an upper side of the paper money to be delivered are mainly shown.

FIGS. 4 and 5 are top views of the paper sheet feed mechanism 100 shown in FIG. 1. In FIG. 4, among the components of the paper sheet feed mechanism 100, components arranged in a lower side of the paper money to be delivered are mainly shown, and in FIG. 5, components arranged in an upper side of the paper money to be delivered are mainly shown.

First, FIG. 4 will be explained.

This FIG. 4 shows the push-up board 10, the push-up board lifting/lowering belt 11, and the push-up board drive motor 12, and in the present embodiment, three feed rollers 14 are provided. Three protrusions 10*a* corresponding to three feed rollers 14, respectively, are provided in the push-up board 10, and the paper money are pressed against the feed rollers 14 by these protrusions 10*a*.

Also, this FIG. 4 shows the feed roller holding lever 17 and the on/off sensor 25, and the on/off sensor 25 is provided with a recess through which the detection board 17*a* provided in the feed roller holding lever 17 passes.

This FIG. 4 shows the separator holding levers 20 and also the supplementary rollers 22 attached to the separator holding levers 20 and pressed against the feed rollers 14. In the present embodiment, two separators 19 are arranged so as to be alternately positioned to three feed rollers 14.

In the right of FIG. 4, further shown are the conveyance rollers 23 and the conveyance roller drive motor 24 driving the conveyance rollers 23.

Next, FIG. 5 will be explained.

The feed rollers 14 are shown in a center part of FIG. 5. The paper sheet feed mechanism 100 is provided with a feed roller drive belt 26, a feed roller drive shaft 27, and a feed roller drive motor 28, and the feed rollers 14 are driven by the feed roller drive motor 28 via the feed roller drive shaft 27 and the feed roller drive belt 26. The feed roller drive shaft 27 is positioned at the supporting point (refer to FIG. 1) of the feed roller holding lever 17, and the distance between the feed roller drive shaft 27 and the axis of the feed roller 14 is constant even when the feed roller holding lever 17 rotates. Thus, drive force is surely transmitted by the feed roller drive belt 26.

Two dotted lines L superposed on the shaft of the feed rollers 14 and shown in FIG. 5 show respective positions of a wall of the storage and an edge of the push-up board, and an edge of the paper money exists adjacent to this. That is, the feed rollers 14 are in contact with the vicinity of the edge of the paper money to let the paper money pass between the feed rollers 14 and the separators 19 in such a manner that the paper money is pulled to be conveyed to the conveyance roller 23, and thus the paper money is surely conveyed to the conveyance roller 23.

In the present embodiment, the two pick roller holding levers 16 are arranged so as to be alternately positioned to the three feed rollers 14, and the respective pick rollers 15 are held in the respective pick roller holding levers 16. Three gears 29 for transmitting the rotation of the each feed roller 14 to the each pick roller 15 are arranged. Transmission method of the rotation will be described later on. The pick rollers 15 are in contact with the vicinity of the center of the paper money, and the paper money is conveyed toward the feed rollers 14, whereby the paper money surely comes in contact with the feed roller 14 even when there is unevenness in accommodation positions of the paper money. The feed roller 14 can thus surely convey the paper money, and delivery of the paper money becomes stable.

Figure 6:
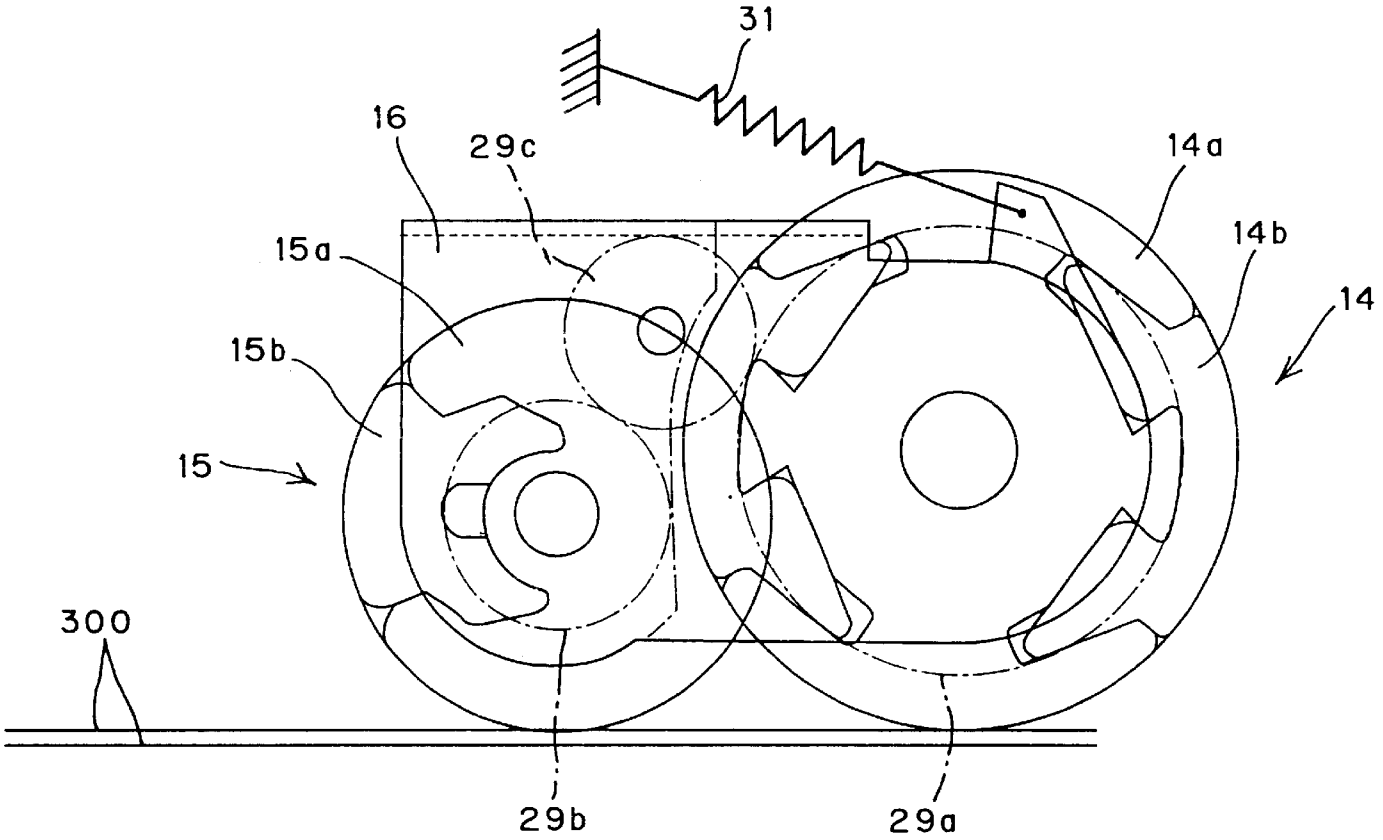
FIG. 6 is a detail view of the feed roller and the pick roller.

FIG. 6 is a detail view of the feed roller and the pick roller.

This FIG. 6 shows the feed roller 14, the pick roller 15, and the paper money 300 pressed against the feed roller 14 and the pick roller 15, and the respective feed roller 14 and pick roller 15 are formed by combining low friction portions 14*a*, 15*a* made of a material with a low coefficient of friction and high friction portions 14*b*, 15*b* made of a material with a high coefficient of friction. The feed roller 14 has two high friction portions 14*b*, and the pick roller 15 has one high friction portion 15*b*.

In this FIG. 6, shown by three circles are a gear 29*a* rotating along with the feed roller 14, a gear 29*b* rotating along with the pick roller 15, and a gear 29*c* engaging both these gears 29*a*, 29*b*. Here, the number of tooth of the gear 29*a* rotating along with the feed roller 14 is 26, and the number of tooth of the gear 29*b* rotating along with the pick roller 15 is 13. That is, the ratio of the numbers of tooth is two to one, and the rotation of the feed roller 14 is transmitted to the pick roller 15 by the three gears 29*a*, 29*b*, 29*c* so that the pick roller 15 makes two revolutions while the feed roller 14 makes one revolution. That is, timings that the respective high friction portions 14*b*, 15*b* of the feed roller 14 and the pick roller 15 come in contact with the paper money are synchronized, and one example of the drive mechanism referred to in the present invention is composed of these three gears 29*a*, 29*b*, 29*c*, and the feed roller drive motor and the feed roller drive belt described above.

Here, another example more preferable than the example shown in FIG. 6 of the drive mechanism of the present invention will be explained.

Figure 7:
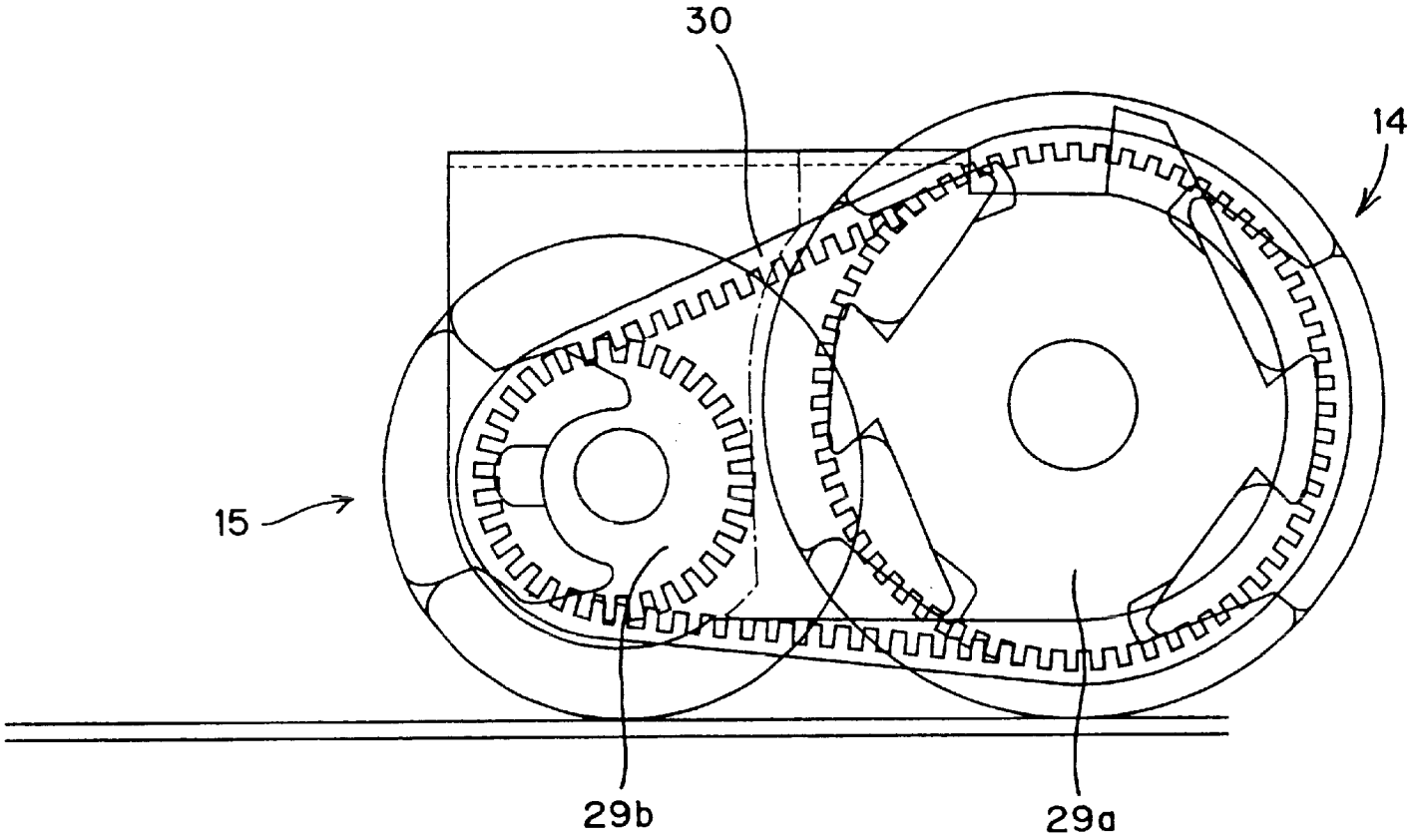
FIG. 7 is a view showing another example of the drive mechanism of the present invention.

FIG. 7 is a view showing another example of the drive mechanism of the present invention.

This FIG. 7 shows the gear 29*a* rotating along with the feed roller 14, the gear 29*b* rotating along with the pick roller 15, and a timing belt 30 engaging both these gears 29*a* and 29*b*. Similar to the explanation on FIG. 6, the ratio of the number of tooth of the gear 29*a* and the number of tooth of the gear 29*b* is two to one, and the pick roller 15 makes two revolutions while the feed roller 14 makes one revolution by the transmission of the rotation by the gears 29*a* and 29*b* and the timing belt 30. That is, another example of the drive mechanism referred to in the present invention is composed of these gears 29*a* and 29*b* and timing belt 30 and the feed roller drive motor and feed roller drive belt described above.

In the example in which the timing belt is employed, since the number of the rotary shafts is one less, compared with the example in which three gears are employed, implementation of the example in which the timing belt is employed is easier than that of the example in which the three gears are employed.

Since the same result is produced even if any one example among the two examples of the drive mechanisms is adopted in the explanation below, it will not be distinguished which example among the two examples is adopted in the explanation below. However, for the sake of simplicity in drawing, the example in which the three gears are employed is drawn.

Returning to FIG. 6, the explanation will be continued.

Since a portion on which ink is dark or a portion of watermark or the like exists in the paper money 300, its thickness is uneven. Paper sheets of various use condition are piled up inside the storage. Because of this, when a large amount of the paper money 300 is piled up inside the storage, paper money 300 piled up in an upper part becomes uneven. This FIG. 6 shows the pick roller holding lever 16 and a spring 31 urging the pick roller 15 together with the pick roller holding lever 16 downward, and since the pick roller 15 is urged downward by the spring 31, the pick roller 15 is surely in contact with the paper money 300 even when the paper money 300 is uneven, whereby the paper money 300 is surely fed to the feed roller 14 by the pick roller 15.

Here, the diameter of the feed roller 14 is 40 mm, and the diameter of the pick roller 15 is 30 mm. As described above, the pick roller 15 makes two revolutions while the feed roller 14 makes one revolution. Thus, the ratio of the conveyance speed at which the paper money 300 is conveyed by the feed roller 14 to the conveyance speed at which the paper money 300 is conveyed by the pick roller 15 is $$40\times1:30\times2=2:3,$$

and thus the pick roller 15 conveys the paper money 300 at the conveyance speed of 1.5 times the conveyance speed of the feed roller 14.

Figure 8:
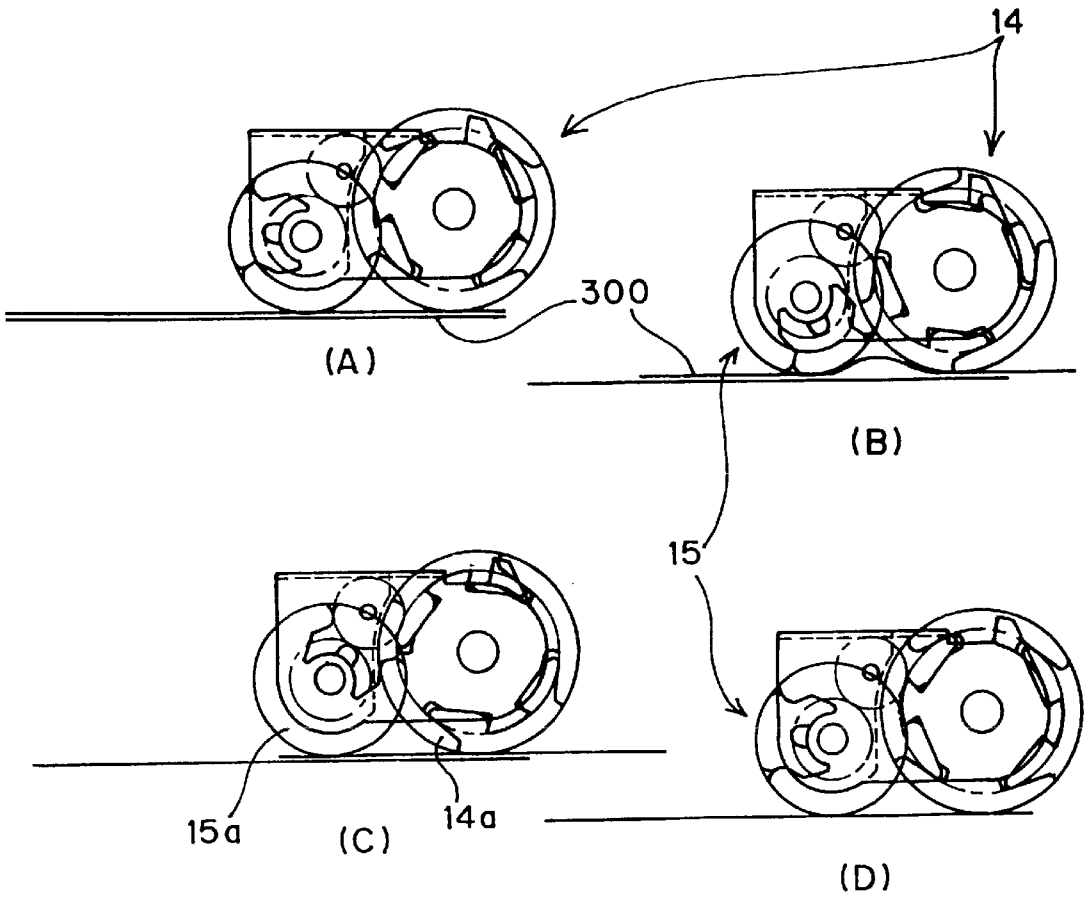
FIG. 8 is a view showing the states where the paper money is conveyed by the feed roller and the pick roller.
Figure 9:
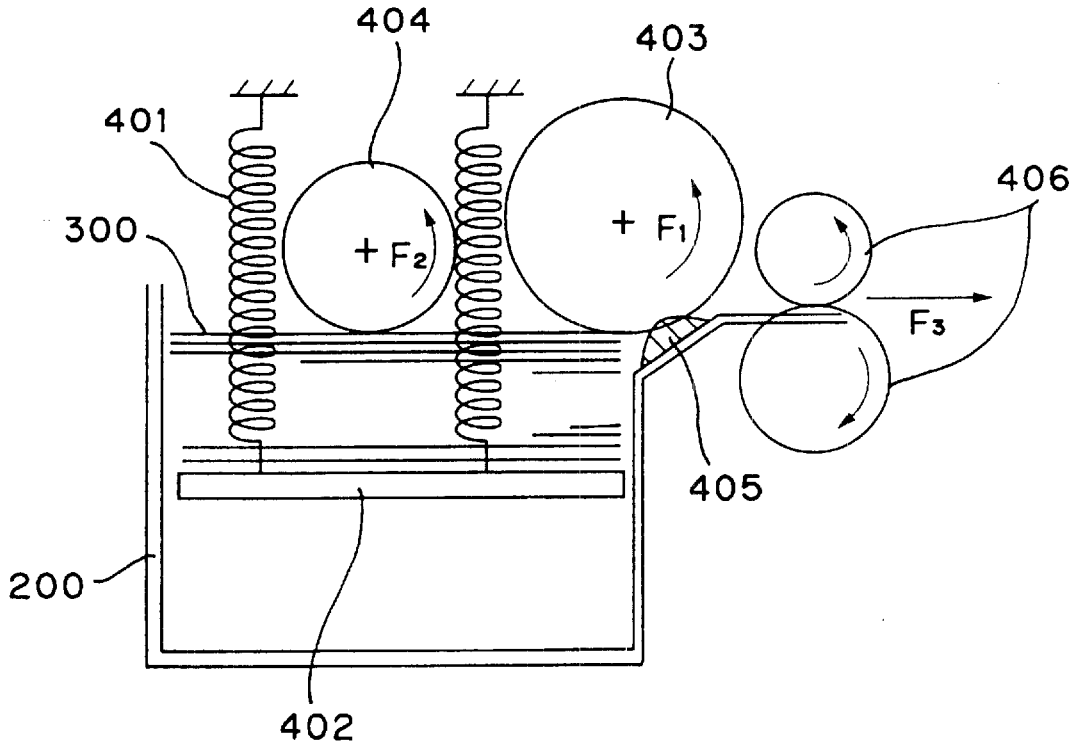
FIG. 9 is a view showing the first example of the conventional paper sheet feed mechanism.
Figure 10:
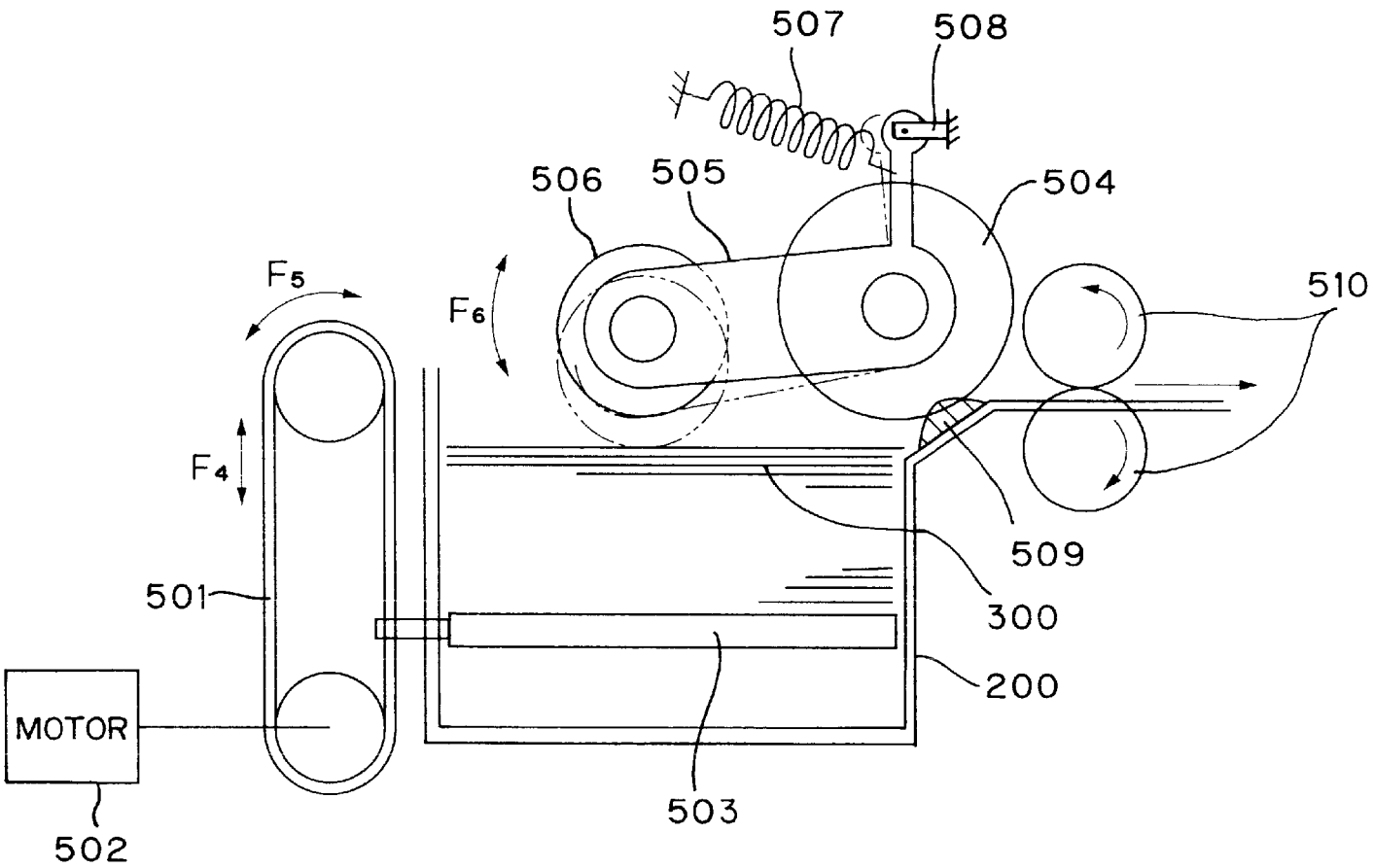
FIG. 10 is a view showing the second example of the conventional paper sheet feed mechanism.

FIG. 8 is a view showing the states where the paper money is conveyed by the feed roller and the pick roller.

FIG. 8(A) shows the same state as that of FIG. 6.

FIG. 8(B) shows the state where the feed roller 14 is counterclockwise rotated 60° from the position shown in FIG. 8(A), and at this time the pick roller 15 is counterclockwise rotated 120°. from the position shown in FIG. 8(A). Since the pick roller 15 feeds the paper money at the conveyance speed of 1.5 times the conveyance speed of the feed roller 14 as described above, the paper money 300 is bent between the pick roller 15 and the feed roller 14, whereby the overlapped paper money is separated. Because of this, even when the frictional resistance generated by the separator is low, the overlap conveyance is fully prevented, and damage or the like of the paper money caused by a high frictional resistance can be prevented.

FIG. 8(C) shows the state where the feed roller 14 is counterclockwise rotated 120° from the position shown in FIG. 8(A), and at this time the pick roller 15 is counterclockwise rotated 240° from the position shown in FIG. 8(A). In the vicinity of the state shown in this FIG. 8(C), the front end of the paper money 300 fed by the feed roller 14 reaches the conveyance rollers described above, and the conveyance by the conveyance rollers is started. The conveyance speed by the conveyance rollers is much faster than the conveyance speed by the feed roller 14 and the pick roller 15, and while both the feed roller 14 and the pick roller 15 are in contact with the paper money at the low friction portions 14*a*, 15*a*, the entire paper money 300 is pulled from the storage to the outside.

FIG. 8(D) shows the state where the feed roller is counterclockwise rotated 180° from the position shown in FIG. 8(A), and at this time the pick roller 14 is counterclockwise rotated 360° from the position shown in FIG. 8(A). The state shown in this FIG. 8(D) is the state exactly equivalent to the state shown in FIG. 8(A).

This operation is repeated so that the paper money is surely conveyed one by one.

Although the feed roller is pressed against the paper money by the spring and the pick roller is urged toward the paper money by the spring in the present embodiment, the press mechanism and an urge mechanism referred to in the present invention may be one that executes pressing or the like by means of a rubber elasticity, an oil damper, electromagnet or the like.

Although the rotation of the feed roller is transmitted to the pick roller by the gears or the like in the present embodiment, the drive mechanism referred to in the present invention may be one that drives the feed roller and the pick roller independently.

Although the magnitude of the press force is two value measured by the on/off sensor in the present embodiment, the press force measuring device referred to in the present invention may be one that measures the magnitude of the press force continuously.

What is claimed is:

1. A paper sheet feed mechanism feeding paper sheets inside a storage inside which the paper sheets are piled up one by one from the storage, said paper sheet feed mechanism comprising:

a feed roller conveying an uppermost paper sheet piled among the paper sheets piled up inside the storage to a predetermined conveyance direction by being in contact with the uppermost paper sheet and rotating, a pick roller being positioned behind the feed roller in the conveyance direction and conveying the uppermost paper sheet with which the feed roller is in contact to the conveyance direction by being in contact with the uppermost paper sheet and rotating, and a conveyance mechanism conveying the paper sheet fed by the feed roller and the pick roller to the outside of the storage, wherein the feed roller is provided one or more of a predetermined number of each of high friction portion(s) having a relatively high coefficient of friction and low friction portion(s) having a relatively low coefficient of friction in the circumferential face of the feed roller alternately in the circumferential direction thereof, the pick roller is provided with one or more of a predetermined number of each of high friction portion(s) having a relatively high coefficient of friction and low friction portion(s) having a relatively low coefficient of friction in the circumferential face of the pick roller alternately in the circumferential direction thereof, the paper sheet feed mechanism comprises a drive mechanism driving the feed roller and the pick roller so that timing that the high friction portion of the feed roller comes in contact with the paper sheet and timing that the high friction portion of the pick roller comes in contact with the paper sheet are synchronized, and wherein a conveyance speed by the pick roller is faster than a conveyance speed by the feed roller.

* * * * *